US005231853A

United States Patent [19]

Nicholson

[11] Patent Number: 5,231,853

[45] Date of Patent: Aug. 3, 1993

[54] NESTING BEZEL STRUCTURE FOR STACKED RINGS

[76] Inventor: Raulette W. Nicholson, 6456 Deep Dell Pl., Hollywood, Calif. 90068

[21] Appl. No.: 852,297

[22] Filed: Mar. 16, 1992

[51] Int. Cl.[5] ..... A44C 9/00

[52] U.S. Cl. ..... 63/15.1

[58] Field of Search ..... 63/15, 15.1, 15.3, 15.4, 63/15.2, 26, 28, 31

[56] References Cited

U.S. PATENT DOCUMENTS

| | | | |
|---|---|---|---|
| 211,558 | 1/1879 | Edwards | 63/15.1 |
| D. 254,537 | 3/1980 | Abelson | 63/15.1 |
| D. 254,606 | 4/1980 | Abelson | 63/15.1 |
| 549,674 | 11/1895 | Lederer | 63/15.4 |
| 1,326,977 | 1/1920 | Schwartzman | 63/15.1 |
| 1,453,708 | 5/1923 | Gaschke | 63/15.1 |
| 1,929,236 | 10/1933 | Bridler | 63/15.1 |
| 2,220,408 | 11/1940 | Kalina | 63/15.1 |

FOREIGN PATENT DOCUMENTS

| | | | |
|---|---|---|---|
| 62-03459 | 6/1987 | Japan | 63/15.1 |

*Primary Examiner*—Peter M. Cuomo

*Assistant Examiner*—Flemming Saether

*Attorney, Agent, or Firm*—Michael A. Painter

[57] ABSTRACT

A nested bezel structure for stacked rings. A plurality of finger rings are each comprised of a cylindrical band and a setting or bezel which is mounted upon and extends outwardly from the circumference of the band. Each bezel is defined by an inner and outer surface. A stone or other adornment is mounted within the inner surface of the bezel. The outer surface of the bezel is in a predetermined, defined relationship to the geometry of the band. The exterior surface of the bezel is cantilevered extending longitudinally beyond the end surface of the band and is defined by a first chord extending outwardly from an origination point lying along the longitudinal axis of the band. The origination point lies at the intersection of a radial chord which is perpendicular to the longitudinal axis of the band and extends between the axis of the band and through the bezel. When the bands are placed in axial abutment with each other, the exterior surface of each bezel will be disposed above the surface of the opposing band, the bezels being in contact with one another along a linear interface.

4 Claims, 1 Drawing Sheet

NESTING BEZEL STRUCTURE FOR STACKED RINGS

BACKGROUND OF THE INVENTION

1. Field of the Invention

The present invention is generally related to multiple finger ring structures, and more particularly, to multiple ring structures forming nested relationships with one another.

2. Prior Art

An examination of the prior art discloses numerous designs for finger rings which employ multiple bands which are intended to be stacked or placed adjacent one another. In the most rudimentary forms, multiple rings are placed adjacent one another solely for the purpose of ornamentation. When viewed in the context of the present invention, the most relevant examples of prior art display a structural relationship between the adjacent bands and settings of the component structure.

One example of prior art employs, a first band comprised of a simple cylindrical structure. A second band is adapted to be stacked or placed adjacent the first band and includes a setting which extends laterally from the surface of the second band. The setting includes a notch which is placed adjacent the exterior surface of the first ring. When in place, the configuration of the setting will prevent inadvertent separation of the ring components. The prior art also discloses a number of ring designs wherein interlocking settings are mounted upon the exterior surfaces of stacked ring components. In these examples of the prior art, each of the component elements includes settings which are complementary to one another. When the bands are placed in axial abutment to one another, each setting includes a component which is interleaved with a portion of the adjacent setting.

The primary inadequacy of the designs exhibited by the prior art is the inability to maximize the surface area which can be used to display mounted stones or the like. The present invention substantially resolves the inadequacies exhibited by the prior art. The present invention employs a plurality of cylindrical bands which are adapted to be placed in axial abutment to one another on the hand of the user. A setting comprising a bezel is secured to the exterior surface of each band and extends laterally from the band in parallel, spaced relation to the longitudinal axis of the band. The bezels of adjacent bands are intended to be in a nested relationship to one another. At the intended interface between each adjacent bezel, the exterior surface thereof is defined by a first chord which extends outwardly from an origination point lying along the longitudinal axis of the band. The origination point is defined by a second chord which is perpendicular to the longitudinal axis of the band and lies in the end plane of the cylindrical band. For adjacent bands of equal radius, respective bezels will contact each other along a surface which is defined by the first chord. By constructing the exterior surface of the bezels in accordance with the defined relationship, the surface area which can be used to display mounted stones is maximized.

SUMMARY OF THE INVENTION

The present invention comprises a structure for stacked rings which provides for the orientation of the settings in a manner which maximizes the use of the available display area. Although the present invention contemplates use of two or more stacked finger rings, for the purpose of explanation the invention will be described utilizing two adjacent ring structures. Furthermore, although the present invention is equally applicable to settings or bezels having a variety of geometrical shapes, the explanation of the present invention shall be limited to conventional settings or bezels having conic configurations.

An assembly in accordance with the present invention utilizes ring structures based upon cylindrical bands of equal diameters. Each cylindrical band is defined by its external cylindrical surface and planar end sections perpendicular to the longitudinal axis of the band. A conical bezel or setting is mounted upon and extends upwardly from the external cylindrical surface of the band. The bezel is mounted upon the band in a predetermined, defined relationship with the geometry of the band. The setting is laterally off-set from a plane bisecting the band whereby the bezel or setting longitudinally extends beyond the end plane of the cylindrical band.

The exterior surface of the conical bezel is in a predetermined, defined relationship with the geometry of the band. The exterior surface of the bezel lies on the surface of a cone which has its apex or origination point at the intersection of the longitudinal axis and an end plane of the cylindrical band. A pair of rings constructed in accordance with the present invention are placed in axial abutment with one another whereby the bezels of each are disposed above the exterior surface of the cylindrical band of the other. By rotating the bands about their longitudinal axis whereby the bezels are urged toward each other, the exterior surfaces of the bezel will be in uniform contact with one another along a linear interface defined by a radial chord extending perpendicular to the longitudinal axis of the stacked bands. A structure in accordance with the present invention maximizes the available display area, the combination giving the appearance of a single ring having a width equal to the sum of the width of each band with adjacent settings located at the center of the combined structure.

It is therefore an objective of the present invention to provide a structure for stacked finger rings which maximizes the ability to use the available display area.

It is another object of the present invention to provide a stacked finger ring structure in which adjacent settings are in contact with one another along a linear interface.

It is still another objective of the present invention to provide a structure of adjacent finger rings which give the impression of a unitary structure with centrally located settings.

It is still yet another object of the present invention to provide an improved nested bezel structure for stacked finger rings which is simple and inexpensive to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

DESCRIPTION OF THE PRESENTLY PREFERRED EMBODIMENT

Figure 1:
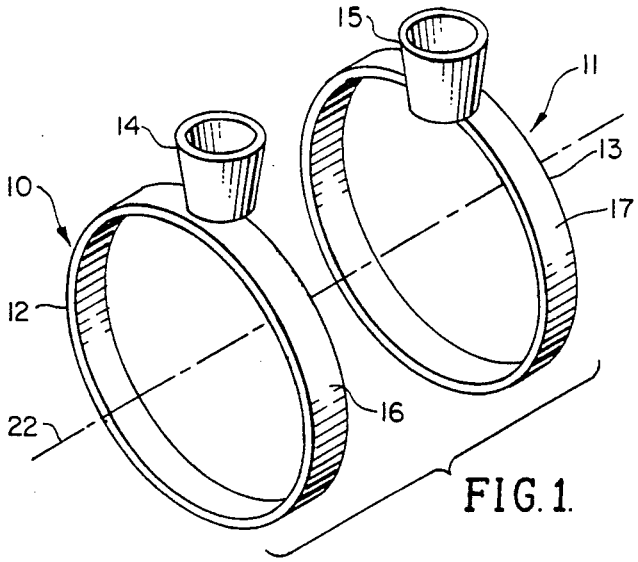
FIG. 1 is an assembly view of two finger rings constructed in accordance with the present invention.

An understanding of the present invention can be best gained by reference to FIG. 1 wherein a pair of finger rings 10 and 11 are shown in axial opposition to each other. The present invention contemplates a grouping of a plurality of finger rings having the same diameter and being adapted to be stacked one against the other. It should be understood that, although the present invention is applicable to an assembly of more than two finger rings, the discussion shall be limited to the stacked assembly of finger rings 10 and 11. Each of the finger rings 10 and 11 comprise a cylindrical band 12 and 13, respectively. As shown in FIG. 1, a setting or bezel 14 is mounted upon the exterior surface 15 of band 12. In a like manner, setting 16 is secured to exterior surface 17 of ring 13. Bands 12 and 13 are cylinders having the same diameter and are adapted to be placed in axial abutment with one another.

Figure 2:
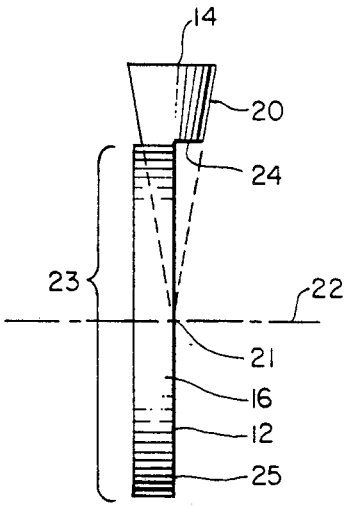
FIG. 2 is a side elevation view of a cylindrical band and bezel in accordance with the present invention.

The construction of finger rings in accordance with the present invention can be best seen by reference to FIG. 2. Although the following discussion is equally applicable to both rings 12 and 13, the description set forth hereinbelow shall be limited to the structure of finger ring 12. Setting or bezel 14 is used to mount a gemstone or other item to be displayed. As can be seen in FIG. 1 and FIG. 2, bezel 14 has an exterior surface 20 which comprises a section of conical surface having its apex or point of origination 21 lying on longitudinal axis 22. The conical surface 20 forming bezel 14 is secured to exterior surface 15 of band 12. The outer diameter of band 12 is represented by reference numeral 23. The cantilevered, bottom edge 24 represents a circular conic section which would be created by the intersection between a bezel 14 in the form of a right cone and a plane perpendicular to the axis of bezel 14. Bezel 14 is secured to surface 15 of band 12, the vertical distance between edge 24 and longitudinal axis 22 being greater than the radius of band 12.

Figure 4:
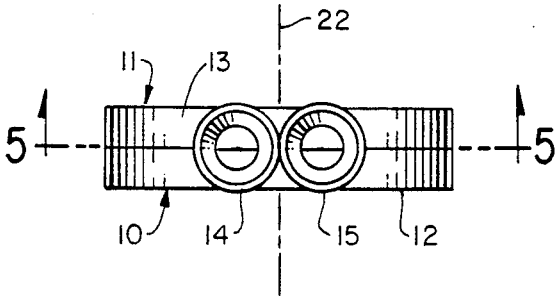
FIG. 4 is a top plan view of the stacked finger rings shown in FIG. 3.

Although the present invention is applicable to bezels or settings having any regular shape, the discussion hereinbelow refers to conic sections for the purpose of example. To achieve the primary objective of the present invention, the exterior surface 20 of bezel 14 has a predetermined, defined relationship to the geometry of band 12. It is an objective of the present invention to provide a pair of finger rings which, when placed in axial abutment with one another, will maximize use of the available surface area. As shown in FIG. 4, when rings 10 and 11 are placed adjacent one another, the assembled elements will give the impression of a single ring having the full width of bands 10 and 11, with bezels 14 and 15 appearing to be centrally located at the midpoint of the stacked rings 10 and 11. This objective is achieved by the displacement between the bezels and the bands as shown in FIG. 2. The angular relationship between the surface 20 of bezel 14 and the geometry of band 12 can be best seen in FIG. 2. Bezel 14 is centrally located over an end plane 25 of band 12. The plane 25 is defined by the cylindrical end surfaces of band 12 and bisects the conic section defining the surface of bezel 14. The slope of the conic section is represented by a chord which extends from the apex or origination point 21 which lies at the intersection of end plane 25 and longitudinal axis 22. Since bezel 14 is uniform in configuration, the slope of the surface immediately above end plane 25 will be identical to any other point on the exterior surface 20 of bezel 14. As will be explained in detail hereinbelow, when rings 10 and 11 are in stacked assembly, bezels 14 and 15 will be in contact along a linear interface which lies within end plane 25.

Figure 3:
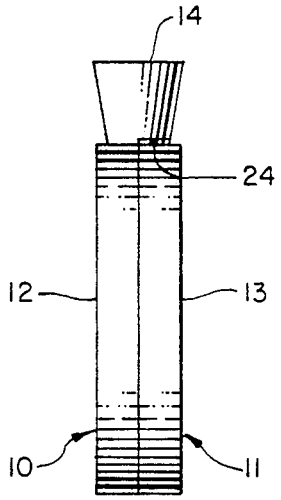
FIG. 3 is aside elevation view of two finger rings employing conical bezels disposed adjacent one another.
Figure 5:
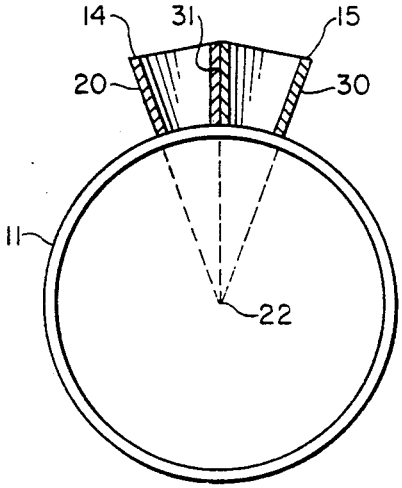
FIG. 5 is a partial, cross-sectional view of the stacked finger rings shown in FIG. 4 taken through line 5—5 of FIG. 4.

A primary objective of the present invention is to provide an assembly of stacked finger rings which permit the bezels or settings to be nested against one another along a linear interface. The implementation of this objective can be best seen by reference to FIGS. 3, 4 and 5. FIG. 3 illustrates a side elevation view of the stacked finger rings 10 and 11. As viewed from a side elevation, bezel 14 is positioned above the interface between bands 12 and 13, the extended edge 24 of bezel 14 being spaced from and positioned above band 13.

The manner in which the present invention maximizes the ability to utilize the available display area can be best seen from FIG. 4. When viewed from above, bezels 14 and 15 are fully positioned within the collective width of bands 12 and 13, the bezels 14 and 15 being contiguous with one another. When employing bands of equal diameter, the nesting of bezels 14 and 15 along the linear interface can be best seen by reference to FIG. 5. The exterior surface of bezel 14 creates a right cone with the apex or origination point lying on longitudinal axis 22. In a like manner, the exterior surface 30 of bezel 15 creates a right cone with its apex or origination point also lying on longitudinal axis 22. Therefore, the exterior surfaces 20 and 30 of bezels 14 and 15 respectively, are radial projections extending from longitudinal axis 22 of cylindrical bands 11 and 12. The tangent of the cone angle will be perpendicular to the radius of band 12. At the point where bezels 14 and 15 are adjacent one another, the tangent intersecting the radial projection will be common to the adjacent surfaces. As a result, bezels 14 and 15 will be in contact with one another along the full linear interface 31 of the exterior surfaces 20 and 30.

It can therefore be seen the present invention provides a new and improved structure for stacked finger rings. When the placement and configuration of the bezels or settings are in a predetermined, defined relationship with the geometry of bands having equal diameters, the usable display area available on the surfaces of the finger rings will be maximized.

I claim:

1. An assembly of stacked finger rings, said assembly comprising a plurality of rings, each of which consists of a cylindrical band having an exterior surface uniformly disposed about the longitudinal axis of the cylindrical band and planar end surfaces which are parallel to each other and perpendicular to the longitudinal axis of the cylindrical band, and a bezel having an exterior surface comprising a section of a right cone of a regular geometrical form secured to the exterior surface of said cylindrical band, a segment of said bezel extending laterally beyond one of the planar end surfaces, the distance between the segment of said bezel and the longitudinal axis of the cylindrical band being greater than the distance between the exterior surface of said cylindrical band and the longitudinal axis thereof, said cylindrical bands being placed in axial abutment with one another, the exterior surfaces of said bezels being uniformly adjacent one another along a linear interface coextensive with the radius of said adjacent cylindrical bands.

2. An assembly of stacked finger rings as defined in claim 1 wherein the conical exterior surface of each of said bezels has it apex at the intersection between the longitudinal axis and the planar end surface of said band.

3. An assembly of stacked finger rings as defined in claim 2 wherein the linear interface between the adjacent bezels lies in a plane formed by the planar end surfaces of said adjacent bands.

4. An assembly of stacked finger rings, said assembly comprising first and second rings, each of which consists of cylindrical bands of equal diameter, each cylindrical band having an exterior surface uniformly disposed about the longitudinal axis of the cylindrical band and planar end surfaces which are parallel to each other and perpendicular to the longitudinal axis of the cylindrical band, a bezel adapted to mount a gemstone having a conical exterior surface, a first portion of the lower terminus thereof being secured to the exterior surface of said cylindrical band, a second portion thereof extending laterally beyond one of the planar end surfaces of said cylindrical band, the distance between the second portion of the lower terminus and the longitudinal axis of said cylindrical band being greater than the distance between the exterior surface of the cylindrical band and its longitudinal axis, said first and second rings being placed in axial abutment with one another, the second portions of the lower terminus of each bezel being disposed above the exterior surface of the adjacent cylindrical band, the conical exterior surfaces of each bezel being in contact with one another along a linear interface aligned with the adjacent planar end surfaces of the first and second cylindrical bands.

* * * * *

UNITED STATES PATENT AND TRADEMARK OFFICE

CERTIFICATE OF CORRECTION

PATENT NO. : 5,231,853

DATED : August 3, 1993

INVENTOR(S) : RAULETTE W. NICHOLSON

It is certified that error appears in the above-indentified patent and that said Letters Patent is hereby corrected as shown below:

Column 3, line 7, "aside" should read --a side--.

Column 3, line 30, "15" should read --16--.

Column 3, line 31, "16" should read --15--.

Column 3, line 32, "ring" should read --band--.

Column 3, line 38, "12 and 13" should read --10 and 11--.

Column 3, line 40, "12" should read --10--.

Column 3, line 46, "15" should read --16--.

Column 3, line 52, "15" should read --16--.

Column 3, line 67, "10 and 11" should read --12 and 13--.

Signed and Sealed this

Tenth Day of May, 1994

Bruce Lehman

*Attest:*

BRUCE LEHMAN

*Attesting Officer*

*Commissioner of Patents and Trademarks*